US011392053B2

(12) United States Patent
Kaziev et al.

(10) Patent No.: US 11,392,053 B2
(45) Date of Patent: Jul. 19, 2022

(54) ELECTROPHOTOGRAPHIC PRINTING

(71) Applicant: Hewlett-Packard Development Company, L.P., Spring, TX (US)

(72) Inventors: Boris Kaziev, Nes Ziona (IL); Dani Tulchinski, Nes Ziona (IL); Liora Braun, Nes Ziona (IL); Einat Glick, Nes Ziona (IL); Yair Gellis, Nes Ziona (IL); Debby Margoy, Nes Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/957,020

(22) PCT Filed: Apr. 30, 2019

(86) PCT No.: PCT/US2019/029812
§ 371 (c)(1),
(2) Date: Jun. 22, 2020

(87) PCT Pub. No.: WO2019/213026
PCT Pub. Date: Nov. 7, 2019

(65) Prior Publication Data

US 2020/0393774 A1 Dec. 17, 2020

Related U.S. Application Data

(63) Continuation of application No. PCT/US2018/030157, filed on Apr. 30, 2018.

(51) Int. Cl.
*G03G 13/20* (2006.01)
*G03G 8/00* (2006.01)
*G03G 9/13* (2006.01)

(52) U.S. Cl.
CPC ..... *G03G 13/20* (2013.01); *G03G 8/00* (2013.01); *G03G 9/131* (2013.01)

(58) Field of Classification Search
CPC ..... G03G 13/20
See application file for complete search history.

(56) References Cited

U.S. PATENT DOCUMENTS 5,364,726 A * 11/1994 Morrison ..... G03G 9/12 430/115
5,998,081 A * 12/1999 Morrison ..... G03G 9/0821 430/117.2

(Continued)

FOREIGN PATENT DOCUMENTS

CN 1518504 8/2004
CN 1280110 10/2006

(Continued)

OTHER PUBLICATIONS

Diamond, A.S. (ed). Handbook of Imaging Materials, pp. 242-247, 254-257. (Year: 2001).*

(Continued)

*Primary Examiner* — Peter L Vajda
(74) *Attorney, Agent, or Firm* — Thorpe North & Western LLP

(57) ABSTRACT

The present disclosure relates to an electrophotographic printing method comprising electrophotographically printing a liquid electrophotographic composition onto a substrate. The liquid electrophotographic composition comprises a charge adjuvant and a copolymer of a) ethylene and b) methacrylic acid and/or acrylic acid, wherein 80 to 95 weight % of the units of said copolymer are derived from ethylene. The printed substrate is then subjected to electron beam (EB) radiation.

17 Claims, 4 Drawing Sheets

(56) References Cited

U.S. PATENT DOCUMENTS

| | | | | | |
|---|---|---|---|---|---|
| 6,114,406 | A | | 9/2000 | Caiger et al. | |
| 6,162,570 | A | * | 12/2000 | Maess | G03G 13/045 399/139 |
| 2005/0245651 | A1 | | 11/2005 | Cooper | |
| 2007/0060667 | A1 | | 3/2007 | Jung et al. | |
| 2008/0227020 | A1 | | 9/2008 | Jones et al. | |
| 2011/0217650 | A1 | | 9/2011 | Mor et al. | |
| 2014/0377695 | A1 | | 12/2014 | Kameyama et al. | |
| 2016/0349651 | A1 | * | 12/2016 | Ito | G03G 9/12 |

FOREIGN PATENT DOCUMENTS

| | | | | | |
|---|---|---|---|---|---|
| EP | 1073138 | | | 1/2001 | |
| EP | 3295253 | | | 3/2018 | |
| JP | 2000211249 | | | 8/2000 | |
| JP | 2005-272563 | | * | 6/2005 | C09D 201/00 |
| JP | 2010000788 | | | 1/2010 | |
| WO | 2009151466 | | | 12/2009 | |
| WO | 2016116140 | | | 7/2016 | |
| WO | 2017067610 | | | 4/2017 | |
| WO | 2017117047 | | | 7/2017 | |
| WO | 2017144409 | | | 8/2017 | |
| WO | WO-2017144409 | A1 | * | 8/2017 | B41M 5/0011 |
| WO | 2017162305 | | | 9/2017 | |
| WO | 2018068837 | | | 4/2018 | |

OTHER PUBLICATIONS

Translation of JP 2005-272563.*
International Search Report dated Jul. 11, 2019 for PCT/US2019/029812, Applicant Hewlett-Packard Development Company, L.P.

* cited by examiner

ELECTROPHOTOGRAPHIC PRINTING

BACKGROUND

An electrophotographic printing process involves creating an image on a photoconductive surface or photo imaging plate (PIP). The image that is formed on the photoconductive surface is a latent electrostatic image having image and background areas with different potentials. When an electrophotographic ink composition containing charged toner particles is brought into contact with the selectively charged photoconductive surface, the charged toner particles adhere to the image areas of the latent image while the background areas remain clean. The image is then transferred to a print substrate (e.g. paper) directly, or by first being transferred to an intermediate transfer member (e.g. a blanket) and then to the print substrate.

BRIEF DESCRIPTION OF THE FIGURES

Various features and aspects will be described, by way of example only, with reference to the following figures, in which.

DETAILED DESCRIPTION

Figure 1:
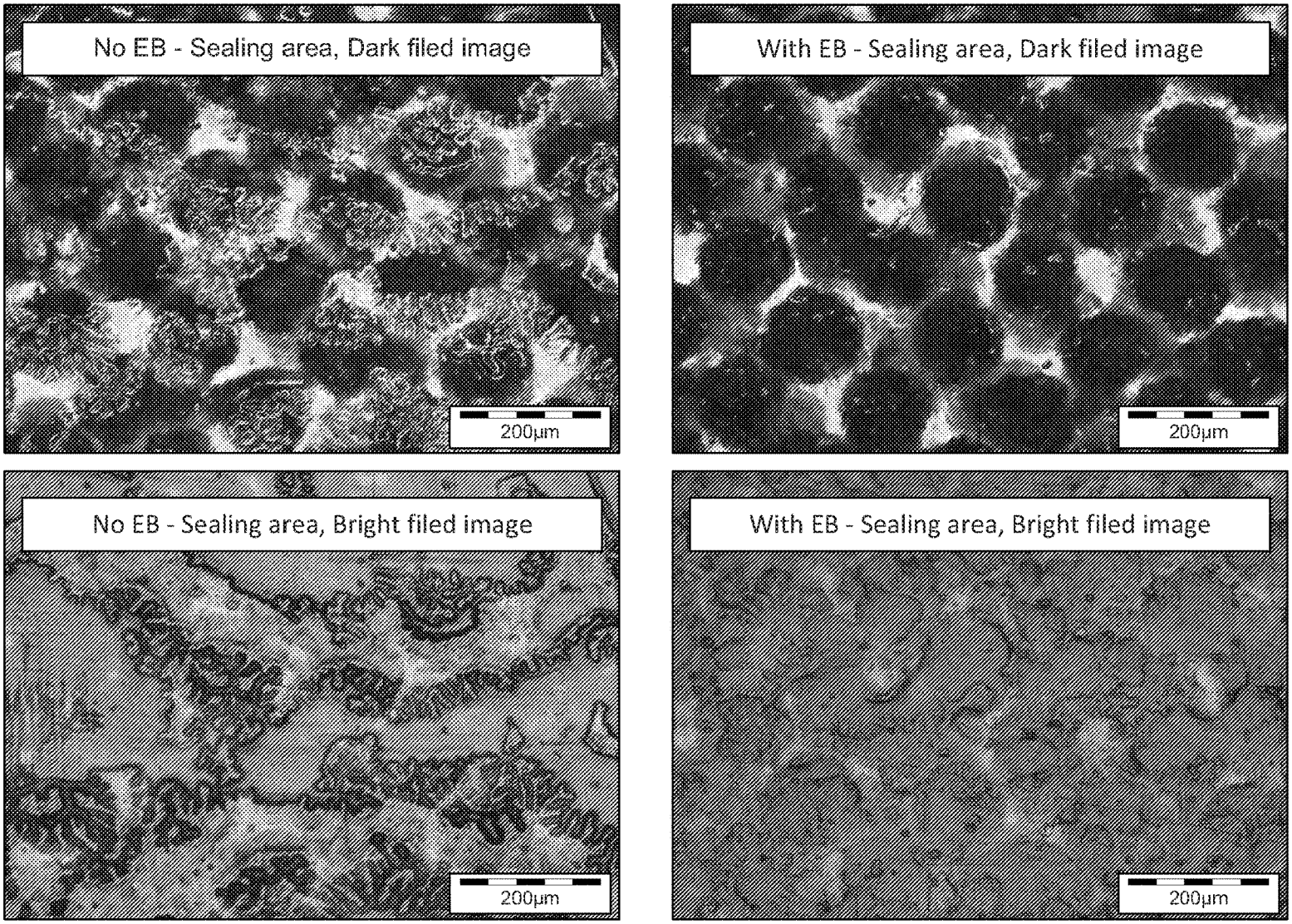
FIG. 1 shows optical microscope images of non-irradiated and EB irradiated substrates produced in Example 1.

Before the present disclosure is disclosed and described, it is to be understood that this disclosure is not limited to the particular process steps and materials disclosed in this disclosure because such process steps and materials may vary. It is also to be understood that the terminology used in this disclosure is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used in this disclosure, "carrier fluid", "carrier liquid," "carrier," or "carrier vehicle" refers to the fluid in which polymers, particles, charge directors and other additives can be dispersed to form a liquid electrostatic composition or liquid electrophotographic composition. The carrier liquids may include a mixture of a variety of different agents, such as surfactants, co-solvents, viscosity modifiers, and/or other possible ingredients.

As used in this disclosure, "electrophotographic composition" or "electrostatic composition" generally refers to a composition, which is suitable for use in an electrophotographic or electrostatic printing process. The electrophotographic composition may comprise chargeable particles of polymer dispersed in a carrier liquid. The term may refer to an electrophotographic ink composition.

As used herein, "electrophotographic ink composition", which may be termed an "electrostatic ink composition", generally refers to an ink composition, which may be in liquid form. The composition is suitable for use in an electrophotographic or electrostatic printing process. The electrophotographic ink composition may include chargeable particles of polymer dispersed in a carrier liquid. The composition may include a colorant that is visible to the eye.

As used herein, "colorant" generally includes pigments or dyes that are visible by eye.

As used in this disclosure, "co-polymer" refers to a polymer that is polymerized from at least two monomers. The term "terpolymer" refers to a polymer that is polymerized from 3 monomers.

As used in this disclosure, "melt index" and "melt flow rate" are used interchangeably. The "melt index" or "melt flow rate" refers to the extrusion rate of a resin through an orifice of defined dimensions at a specified temperature and load, reported as temperature/load, e.g. 190° C./2.16 kg. In the present disclosure, "melt flow rate" or "melt index" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrostatic composition.

As used in this disclosure, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used in this disclosure, "melt viscosity" generally refers to the ratio of shear stress to shear rate at a given shear stress or shear rate. Testing may be performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate. If the melt viscosity of a particular polymer is specified, unless otherwise stated, it is the melt viscosity for that polymer alone, in the absence of any of the other components of the electrostatic composition.

A polymer may be described as comprising a certain weight percentage of monomer. This weight percentage is indicative of the repeating units formed from that monomer in the polymer.

If a standard test is mentioned in this disclosure, unless otherwise stated, the version of the test to be referred to is the most recent at the time of filing this patent application.

As used in this disclosure, "electrostatic printing" or "electrophotographic printing" refers to the process that provides an image that is transferred from a photo imaging plate either directly or indirectly via an intermediate transfer member to a print substrate. As such, the image may not be substantially absorbed into the photo imaging substrate on which it is applied. Additionally, "electrophotographic printers" or "electrostatic printers" refer to those printers capable of performing electrophotographic printing or electrostatic printing, as described above. An electrophotographic printing process may involve subjecting the electrophotographic composition to an electric field, e.g. an electric field having a field gradient of 1-400V/μm, or more, in some examples 600-900V/μm, or more.

As used in this disclosure, "substituted" may indicate that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used in this disclosure, "heteroatom" may refer to nitrogen, oxygen, halogens, phosphorus, or sulfur.

As used in this disclosure, "alkyl", or similar expressions such as "alk" in alkaryl, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms, for example.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described in this disclosure may contain, but are not limited to, from 5 to about 50 carbon atoms, or 5 to about 40 carbon atoms, or 5 to 30 carbon atoms or more, and may be selected from, phenyl and naphthyl.

Unless the context dictates otherwise, the terms "acrylic" and "acrylate" refer to any acrylic or acrylate compound. For example, the term "acrylic" includes acrylic and methacrylic compounds unless the context dictates otherwise. Similarly, the term "acrylate" includes acrylate and methacrylate compounds unless the context dictates otherwise.

As used in this disclosure, the term "about" is used to provide flexibility to a numerical range endpoint by providing that a given value may be a little above or a little below the endpoint to allow for variation in test methods or apparatus. The degree of flexibility of this term can be dictated by the particular variable and would be within the knowledge of those skilled in the art to determine based on experience and the associated description in this disclosure.

As used in this disclosure, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented in this disclosure in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used in this disclosure, weight % (wt %) values are to be taken as referring to a weight-for-weight (w/w) percentage of solids in the composition, and not including the weight of any carrier fluid present.

The present disclosure relates to an electrophotographic printing method comprising electrophotographically printing a liquid electrophotographic composition onto a substrate. The liquid electrophotographic composition comprises a charge adjuvant and a copolymer of a) ethylene and b) methacrylic acid and/or acrylic acid, wherein 80 to 95 weight % of the units of said copolymer are derived from ethylene. The printed substrate is then subjected to electron beam (EB) radiation.

The present disclosure also relates to a printed substrate comprising a print substrate and an electrophotographic ink layer printed on the print substrate. The electrophotographic ink layer comprises a charge adjuvant and a copolymer of a) ethylene and b) methacrylic acid and/or acrylic acid, wherein 80 to 95 weight % of the units of said copolymer are derived from ethylene. The units derived from ethylene have increased branching to the polymer network over the print substrate.

It has been determined that, by subjecting the printed substrate to electron beam radiation, the electron beam radiation influences the mechanical and thermal properties of the electrophotographic ink composition. Our results show that, at least in certain examples, the exposure to electron beam radiation can cause a decrease in the room-temperature plasticity of the printed ink composition, but with substantially no or little change in ink elasticity, and/or with an increase in thermal resistance.

In some examples, it is believed that the ethylene-derived copolymer units can show increased branching of the polymer network over the substrate following exposure to electron beam radiation. This increased branching of the polymer network may improve the mechanical and/or thermal properties of the printed image, for example, with respect to durability, heat and/or water resistance. Accordingly, by controlling the proportion of ethylene in the copolymer, the degree of increased branching achieved upon exposure to electron beam radiation may be controlled to improve the mechanical and/or thermal properties of the printed image. Without wishing to be bound to any theory, the increased branching resulting from exposure to electron beam radiation can cause strain hardening of the ink composition. In some examples, even a small increase in branching may have a significant effect on the thermal properties of the printed ink composition.

At the same time, the proportion of methacrylic acid and/or acrylic acid units may be controlled to provide the copolymer with the charge characteristics required for electrophotographic printing.

Copolymer

As described above, the electrophotographic composition includes a copolymer of a) ethylene and b) methacrylic acid and/or acrylic acid, wherein 80 to 95 weight % of the units of said copolymer are derived from ethylene. In some examples, 84 to 92 weight % of the units of said copolymer are derived from ethylene. In some examples, 85 to 91 weight % of the units of said copolymer are derived from ethylene. In some examples, 5 to 20 weight % of the units of said copolymer are derived from methacrylic acid and/or acrylic acid. In some examples, 8 to 16 weight % of the units of said copolymer are derived from methacrylic acid and/or acrylic acid. In some examples, 9 to 15 weight % of the units are derived from methacrylic acid and/or acrylic acid.

In some examples, the copolymer may comprise a copolymer of a) ethylene and b) methacrylic acid. In some examples, 80 to 95 weight % of the units of said copolymer are derived from ethylene. In some examples, 84 to 92 weight % of the units of said copolymer are derived from ethylene. In some examples, 5 to 20 weight % of the units of said copolymer are derived from methacrylic acid. In some examples, 8 to 16 weight % of the units of said copolymer are derived from methacrylic acid. In one example, the copolymer is a copolymer of ethylene and methacrylic acid sold under the trademark Nucrel®.

In some examples, the copolymer may comprise a copolymer of a) ethylene and b) acrylic acid. In some examples, 80 to 95 weight % of the units of said copolymer are derived from ethylene. In some examples, 84 to 92 weight % of the units of said copolymer are derived from ethylene. In some examples, 5 to 20 weight % of the units of said copolymer are derived from acrylic acid. In some examples, 8 to 16 weight % of the units of said copolymer are derived from acrylic acid. In one example, the copolymer is a copolymer of ethylene and methacrylic acid sold under the trademark Honeywell AC®.

In some examples, a blend of copolymers may be employed. For instance, the copolymer may comprise a first copolymer that is a copolymer of ethylene and methacrylic acid, and a second copolymer that is a copolymer of ethylene and acrylic acid. In some examples, the ethylene content of the first copolymer may be greater than the ethylene content of the second copolymer.

In the first copolymer, 80 to 95 weight % of the units of the copolymer may be derived from ethylene. In some examples, 84 to 92 weight % of the units of said copolymer may be derived from ethylene. In some examples, 5 to 20 weight % of the units of said copolymer may be derived from methacrylic acid. In some examples, 8 to 16 weight % of the units of said copolymer may be derived from methacrylic acid. In one example, the first copolymer may be a copolymer of ethylene and methacrylic acid sold under the trademark Nucrel®

In the second copolymer, 80 to 95 weight % of the units of the second copolymer may be derived from ethylene. In some examples, 84 to 92 weight % of the units of said copolymer may be derived from ethylene. In some examples, 5 to 20 weight % of the units of said copolymer may be derived from acrylic acid. In one example, the second copolymer may be a copolymer of ethylene and methacrylic acid sold under the trademark Nucrel® or Honeywell AC®.

In one example, the weight ratio of the first copolymer to the second copolymer may be 60-95:5-40. In one example, the weight ratio of the first copolymer to the second copolymer may be 70-90:30-10. In one example, the weight ratio of the first copolymer to the second copolymer may be 75-85:25-15.

The concentration of ethylenically unsaturated groups in the copolymer (or copolymer blend) may be less than 0.05 meq/g. In some examples, the concentration of ethylenically unsaturated groups in the copolymer (or copolymer blend) may be less than 0.04 meq/g, less than 0.03 meq/g, less than 0.02 meq/g, or less than 0.01 meq/g. In some examples, the copolymer (copolymer blend) may be substantially free of ethylenically unsaturated groups.

The copolymer in the electrophotographic composition may have a melting point of less than 110 degrees C., for example, less than 100 degrees C., for instance, less than 98 degrees C. The copolymer may have a melting point of greater than 85 degrees C., for example, greater than 87 degrees C. The copolymer may have a melting point in the range of 85 to 110 degrees C., for example, 87 to 100 degrees C. or 90 to 98 degrees C.

The polymer resin may have (or may contain a polymer having) an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer may have an acidity of 200 mg KOH/g or less, in some examples 190 mg or less, in some examples 180 mg or less, in some examples 130 mg KOH/g or less, in some examples 120 mg KOH/g or less. In some examples, the acidity may range from 50 to 200 mg KOH/g, 60 to 180 mg KOH/g, for example, 90 to 130 mg KOH/g. Acidity of a polymer, as measured in mg KOH/g can be measured using standard procedures known in the art, for example using the procedure described in ASTM D1386.

The resin may comprise a polymer that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The resin may comprise a polymer having a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as ionomers sold under the trademark SURLYN®. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described in this disclosure. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin in the electrophotographic composition comprises a single type of polymer, the polymer (excluding any other components of the electrostatic composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

The resin can constitute about 5 to up to 100 weight %, in some examples about 50 to 99%, by weight of the solids of the liquid electrophotographic composition. The resin can constitute about 60 to 95%, in some examples about 70 to 95%, by weight of the solids of the liquid electrophotographic composition.

Charge Adjuvant

As mentioned above, the electrophotographic composition includes a charge adjuvant. A charge adjuvant may be present with a charge director, and may be different to the charge director, and act to increase and/or stabilise the charge on particles, e.g. resin-containing particles, of an electrostatic composition. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of the liquid electrophotographic composition. The charge adjuvant can constitute about 0.5 to 4 by weight of the solids of the liquid electrophotographic composition. The charge adjuvant can constitute about 1 to 3% by weight of the solids of the liquid electrophotographic composition.

For the avoidance of doubt, the charge adjuvant used in the electrophotographic ink composition may be the same or different to the charge adjuvant used in the electrophotographic varnish composition.

Charge Director

The electrophotographic composition may also include a charge director. In some examples, the charge director comprises nanoparticles of a simple salt and a salt of the general formula $MA_n$, wherein M is a barium, n is 2, and A is an ion of the general formula $[R_1—O—C(O)CH_2CH(SO_3^-)C(O)—O—R_2]$, where each of $R_1$ and $R_2$ is an alkyl group e.g. as discussed above.

The sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 10 nm or less, in some examples 2 nm or more (e.g. 4-6 nm).

The simple salt may comprise a cation selected from Mg, Ca, Ba, $NH_4$, tert-butyl ammonium, $Li^+$, and $Al^{+3}$, or from any sub-group thereof. In one example, the simple salt is an inorganic salt, for instance, a barium salt. The simple salt may comprise an anion selected from $SO_4^{2-}$, $PO^{3-}$, $NO_3^-$, $HPO_3^{2-}$, $CO_3^{2-}$, acetate, trifluoroacetate (TFA), $Cl^-$, $Bf^-$, $F^-$, $ClO_4^-$, and $TiO_3^{4-}$, or from any sub-group thereof. In some examples, the simple salt comprises a hydrogen phosphate anion.

The simple salt may be selected from $CaCO_3$, $Ba_2TiO_3$, $Al_2(SO_4)_3$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. In one example, the simple salt may be $BaHPO_4$.

In the formula $[R_1—O—C(O)CH_2CH(SO_3^-)C(O)—O—R_2]$, in some examples, each of $R_1$ and $R_2$ is an aliphatic alkyl group. In some examples, each of $R_1$ and $R_2$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$.

In an electrophotographic composition, the charge director can constitute about 0.001% to 20%, in some examples 0.01 to 20% by weight, in some examples 0.01 to 10% by weight, in some examples 0.01 to 1% by weight of the solids of the electrostatic composition. The charge director can constitute about 0.001 to 0.15% by weight of the solids of the liquid electrophotographic composition, in some examples 0.001 to 0.15%, in some examples 0.001 to 0.02% by weight of the solids of the liquid electrophotographic composition. In some examples, the charge director imparts a negative charge on the electrostatic composition. The particle conductivity may range from 50 to 500 pmho/cm, in some examples from 200-350 pmho/cm.

Liquid Carrier

The electrophotographic composition may also include a liquid carrier. Generally, the carrier liquid for the liquid electrophotographic composition can act as a dispersing medium for the other components in the electrostatic composition. For example, the carrier liquid can comprise or be a hydrocarbon, silicone oil, vegetable oil, etc. The carrier liquid can include, but is not limited to, an insulating, non-polar, non-aqueous liquid that can be used as a medium for toner particles. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the carrier liquids include, but are not limited to, aliphatic hydrocarbons, isoparaffinic compounds, paraffinic compounds, dearomatized hydrocarbon compounds, and the like. In some examples, the carrier liquid is an isoparaffinic liquid. In particular, the carrier liquids can include, but are not limited to liquids sold under the trademarks, Isopar-G™, IsoparH™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before printing, the carrier liquid can constitute about 20% to 99.5% by weight of the electrostatic composition, in some examples 50% to 99.5% by weight of the electrostatic composition. Before printing, the carrier liquid may constitute about 40 to 90 by weight of the electrostatic composition. Before printing, the carrier liquid may constitute about 60% to 80% by weight of the electrostatic composition. Before printing, the carrier liquid may constitute about 90% to 99.5% by weight of the electrostatic composition, in some examples 95% to 99% by weight of the electrostatic composition.

The composition when printed on the print substrate, may be substantially free from carrier liquid. In an electrostatic printing process and/or afterwards, the carrier liquid may be removed, e.g. by an electrophoresis processes during printing and/or evaporation, such that substantially just solids are transferred to the print substrate. Substantially free from carrier liquid may indicate that the ink or varnish printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the ink or varnish printed on the print substrate is free from carrier liquid.

Colorants

The electrophotographic composition may include a colorant. The colorant may be selected from a pigment, dye and a combination thereof. The colorant may be unicolor or composed of any combination of available colours. In one example, the electrophotographic ink composition includes at least one colorant selected from a cyan colorant, a yellow colorant, a magenta colorant and a black colorant. Thus, the ink may be a yellow, cyan, magenta or black ink. The electrophotographic ink composition may include a plurality of colorants. For example, the electrophotographic ink composition may include a first colorant and second colorant, which are different from one another. The colorant may be selected from a phthalocyanine colorant, an indigold colorant, an indanthrone colorant, a monoazo colorant, a diazo colorant, inorganic salts and complexes, dioxazine colorant, perylene colorant, anthraquinone colorants, and any combination thereof.

Where present, the colorant may be present in an amount of 0.1 to 10 weight %, for instance, 2 to 5 weight % of the total weight of solids of the composition.

Printing Process and Print Substrate

In some examples, the electrophotographic compositions as described in this disclosure may be printed onto a substrate using a liquid electrophotographic printer. In the liquid electrophotographic printer, an image is first created on a photoconductive surface or photo imaging plate (PIP). The image that is formed on the photoconductive surface is a latent electrostatic image having image and background areas with different potentials. When an electrophotographic composition containing charged toner particles is brought into contact with the selectively charged photoconductive surface, the charged toner particles adhere to the image areas of the latent image while the background areas remain clean. The image is then transferred to a print substrate (e.g. paper) either directly or by first being transferred to an intermediate transfer member (e.g. a soft swelling blanket) and then to the print substrate.

The printed substrate may then be subjected to electron beam radiation. Any suitable dose may be employed. For example, electron energies of 10 to 300 keV may be employed, for instance, 20 to 250 keV or 30 to 200 keV. In some examples, electron energies of 50 to 150 keV may be employed, for instance, 60 to 130 keV.

The printed substrate may be irradiated at an electron beam dose of about 15 kGy (1.5 MRad) or higher, up to about 250 kGy (25 MRad). In some examples, the dose may be up to about 180 kGy (18 MRad) or up to about 120 kGy (12 MRad). In some examples, the dose may be about 20 kGy (2 MRad) or higher or about 30 kGy (3 MRad) or higher. In further examples, the dose may be within the range of about 15 kGy to about 250 kGy (about 1.5 MRad to about 25 MRad), for example, about 20 kGy to about 180 kGy (2 to 18 MRad) or about 40 kGy to about 120 kGy (4 to 12 MRad).

The electron beam irradiation may be performed under reduced oxygen conditions. For example, the electron beam irradiation may be performed under a vacuum or by application of an inert gas blanket, for instance, a nitrogen blanket. In some examples, the oxygen concentration may be less than 300 ppm, for example, less than 250 pm or less than 150 ppm.

After electron beam irradiation, the substrate may be subjected to heat, for example, as part of a sealing or lamination process. The substrate may be heated to temperatures of above 100 degrees C., for example, from 100 to 250 degrees C. In some examples, the substrate may be heated to 110 to 240 degrees C., for instance, 115 to 200 degrees C. The substrate may also be subjected to pressure. For example, pressures of 20 to 120 N/cm$^2$ may be applied, for instance, 20 to 110 N/cm$^2$ or 40 to 100 N/cm$^2$.

In some examples, a primer may be applied to the print substrate prior to electrophotographic printing. Any suitable primer may be employed. Examples include polymer dispersions, for instance, a dispersion of olefin polymer. In some examples, a dispersion of an ethylene copolymer may be employed. A suitable dispersion is available from Michelman under the trademark Digiprime®, for instance, Digiprime® 050.

In some examples, the primer may be a poly(ethyleneimine) (PEI). The polymer may contain primary (e.g. —$NH_2$), secondary (e.g. >NH) and tertiary (e.g. >N—) amine groups. In some examples, the primer may be formed by polymerisation of ethyleneimine.

The primer, where employed, may be applied by any suitable method. For example, the primer may be applied by digital or analogue methods. In some examples, the primer may be applied in-line with the electrophotographic printer.

In some examples, an overprint varnish may be applied over the electrophotographically printed image. Any suitable varnish e.g. an electron beam curable varnish may be applied.

The print substrate may be any suitable substrate. The substrate may be any suitable substrate capable of having an image printed thereon. The substrate may include a material selected from an organic or inorganic material. The material may include a natural polymeric material, e.g. cellulose. The material may include a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. In an example, the substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, a primer may be coated onto the print substrate, before the electrostatic composition is printed onto the print substrate.

Various examples will now be described.

Example 1—Thermal Resistance Improvement—Sealing Test

A pre-laminated substrate of PET12/OPA15/CPP80 was coated with 0.17 dry gsm of DP050 primer (Digiprime® 050 from Michelman), using in-line coating on HP Indigo WS6600 digital press. It was then used for LEP surface print using a liquid electrophotographic ink composition (high ink coverage (300-360%)).

The liquid electrophotographic ink composition contained a first copolymer of 85 to 92 weight % ethylene and 8 to 15 weight % methacrylic acid, and a second copolymer of 80 to 90 weight % ethylene and 10 to 20 weight % acrylic acid. The weight ratio of the first copolymer to the second copolymer was in the range of 70-90:30-10. The liquid electrophotographic ink composition further included a colorant, charge adjuvant and charge director dispersed in a liquid carrier.

The printed substrate was then irradiated by electron beam. Irradiation voltage was 115 kV with dose of 6 MRad. The substrate was then tested for sealing using semi manual sealer (Brugger HSG-C), with flat jaws heated to 175° C. (top and bottom) for 0.6 sec at 600N. Table 1 compares the heat resistance of irradiated versus non-irradiated substrate (reference). For non-irradiated sample the sealing area exhibit strong image blurring, where the image for substrate after EB was not disturbed. The ink resin strongly flows after thermal sealing for non-irradiated substrate, compared to stable ink resin performance for substrate after EB.

TABLE 1

Visual result of sealed areas on surface printed substrates (without OPV) with and without EB radiation.

| EB voltage [kV] | Dose [MRad] | Sealing temperature [° C.] | Sealing force [N] | Visual result |
|---|---|---|---|---|
| 0 | 0 | 175 | 600 | Strong image blurring |
| 115 | 6 | 175 | 600 | No change |

FIG. 1 shows optical microscope images of non-irradiated (left) and electron beam (EB) irradiated (right) substrates. It can be seen that the non-irradiated ink is more susceptible to a thermal treatment over the sealed area than the EB irradiated ink. The colorant was not affected by sealing. However, with the non-irradiated substrate, the resin (left) was observed to melt and flow more extensively following thermal sealing. In contrast, with the irradiated substrate, almost no flow was observed. The Figure illustrates how EB treatment makes the printed ink more resilient to high temperature and pressure treatment.

Example 2—Sealing Stress Test for Pre-Laminated Surface Printed Application

Example 1 was repeated, only this time the substrates were coated with EB high gloss overprint varnish, OPV EHG-2600 (from Daybreak Technologies Company). The coat weight of OPV was 3.7 gsm. The substrates then were irradiated by EB with voltage of 115 kV and 2 different doses (3 and 6 MRad). The substrates were then tested for sealing stress test, using flat jaws with different temperature range (160, 180 and 190° C. top and bottom) for 1 sec at 600N. Sealing stress test results are summarized in Table 2 attached. The results indicate that for high sealing temperatures higher EB dose is preferred. When using 6 MRad dose, substrate can withstand sealing temperatures up to 190° C. without significant visual change.

TABLE 2

Visual result of sealed areas on surface printed substrates with OPV and different doses versus sealing temperature.

| EB voltage [kV] | Dose [MRad] | OPV Type | OPV coat weight [g/m$^2$] | Sealing force [N] | Sealing temperature [° C.] | Visual result |
|---|---|---|---|---|---|---|
| 115 | 3 | EHG-2600 | 3.7 | 600 | 160 | Good |
| | | | | | 180 | OPV distortion |
| | | | | | 190 | OPV distortion |
| 115 | 6 | EHG-2600 | 3.7 | 600 | 160 | Good |
| | | | | | 180 | Good |
| | | | | | 190 | Slight OPV distortion |

Example 3—Sealing Resistance Test for Mixpap Application

A Mixpap substrate of Paper/Adhesive/Met-PET/Thermo-lacquer (for lids application) was coated with 0.16 dry gsm of DP050 primer (DigiPrime® 050 from Michelman), using in-line coating on HP Indigo 20000 digital press. It was then used for LEP surface print using liquid electrophotographic ink (see Example 1), with high ink coverage (300-360%). The printed substrate was coated with EB high gloss OPV and irradiated by EB, using same conditions as Example 2. The substrate was then tested for sealing to Polystyrene (PS) foil (as a simulation to yogurt container), using radial jaws heated to 190° C. (top) for 1 sec at 300N. Table 3 shows optimum sealing performance that achieved using higher EB dose (6 MRad).

TABLE 3

Visual result of sealed areas on surface-printed substrates with OPV and different doses.

| EB voltage [kV] | Dose [MRad] | OPV Type | OPV coat weight [gr/m$^2$] | Sealing force [N] | Sealing temperature [° C.] | Visual result |
|---|---|---|---|---|---|---|
| 115 | 3 | EHG-2600 | 3.7 | 300 | 190 | Ink flow |
| 115 | 6 | EHG-2600 | 3.7 | 300 | 190 | Good |

Example 4—Water Resistance Performance

Samples for Example 4 were prepared in the same conditions like Example 2. This time two different OPV coat weights were used (3.7 and 2.4 gsm). The samples were irradiated by EB with voltage of 115 kV and three different doses (3, 6 and 9 MRad). Table 4 attached summarizes the dose and coat weights conditions. The substrates with ink high coverage (300-360%) were then tested for water resistance test, where the samples immersed in DI water at room temperature (RT) and at 85° C. for different time periods (as shown in Table 4). After the time period, samples were removed from water and wiped before peeling test. The peeling test conducted by applying an adhesive tape (3M Scotch tape 810) using 2 kg roller on top of OPV layer. The adhesive tape was then peeled off the samples. Peeling resistance determined by visual inspection of the samples after tape was removed. 0% peeling resistance meaning no ink left on the substrate after peeling test (not desired), where 100% peeling indicates no ink removal by the tape (desired result). The results in Table 4 summarize peeling resistance under different conditions. It is clearly seen that substrates can withstand peeling force at least for 1 hour, even at high temperature (85° C.), both for low/high doses and low/high coat weights. After samples immersion in water overnight, the substrates no longer resist to water.

TABLE 4

Summary of water resistance test on high coverage (300-360%) samples coated with EB OPV with different EB dose and OPV coat weights, for different period of time.

| Test # | EB voltage [kV] | Dose [MRad] | OPV coat weight [g/m$^2$] | Peeling (initial ink adhesion) | Water Resistance (30 min @ RT) | Water Resistance (60 min @ RT) | Water Resistance (60 min @ 85° C.) | Water Resistance (overnight @ RT) |
|---|---|---|---|---|---|---|---|---|
| 1 | 115 | 3 | 3.7 | 100 | 100 | 100 | 100 | 10 |
| 2 | 115 | 6 | 3.7 | 100 | 100 | 100 | 100 | 10 |
| 3 | 115 | 6 | 2.4 | 100 | 100 | 100 | 100 | 10 |
| 4 | 115 | 9 | 2.4 | 100 | 100 | 100 | 100 | Not tested |

Example 5—Resistance to High Temperature Pasteurization

Samples for Example 5 were prepared following the same conditions as Example 2. Two different OPV coat weights were used (3.7 and 2.4 gsm). The samples were irradiated by EB with voltage of 115 kV and two different doses (3 and 6MRad). Pouches were prepared using both high (300-360%) and low ink coverage (200%). Sealing conditions for pouch preparation were 210° C. for upper and 120° C. for lower flat jaws. Jaws were pressed twice, using 450N force with 0.6 sec dwell time. The pouches were then filled with hot water (85° C.), sealed and dipped inside a temperature-controlled hot water bath (85° C.) for 60 min, to simulate a pasteurization process. The pouches were then extracted from water bath, wiped and visually inspected discoloration damages in the pouch and sealed areas. Visual appearance results for all pouches revealed no impact, both in pouch and sealed areas. These results indicate that surface-printed EB finishing pouches may withstand pasteurization high temperature process, without suffering visual damage.

Example 6—Nano-Indentation Test

A pre-laminated substrate of PET12/OPA15/CPP80 was coated with 0.15 dry gsm of DP050 primer (DigiPrime® 050 from Michelman), using in-line coating on a HP Indigo 20000 digital press. It was then used for LEP print using three separations of black pigment liquid ElectroInk (EI) (approx. thickness of 3 μm). The printed substrate was then irradiated by EB using an ebeam technologies Core 100/760 machine. The irradiation voltage was 100 kV with doses of 9 and 12 MRad. Three samples were then tested for mechanical properties using a nano-indentation technique—no EB radiation (reference), 9 MRad and 12 MRad using a CSM+ Instruments nano-indenter. The test conditions used were: —linear loading; max load 65 μN; loading and unloading rates 1000 μN/min; pause time 15.0 sec; acquisition rate 10.0 Hz.

Figure 2:
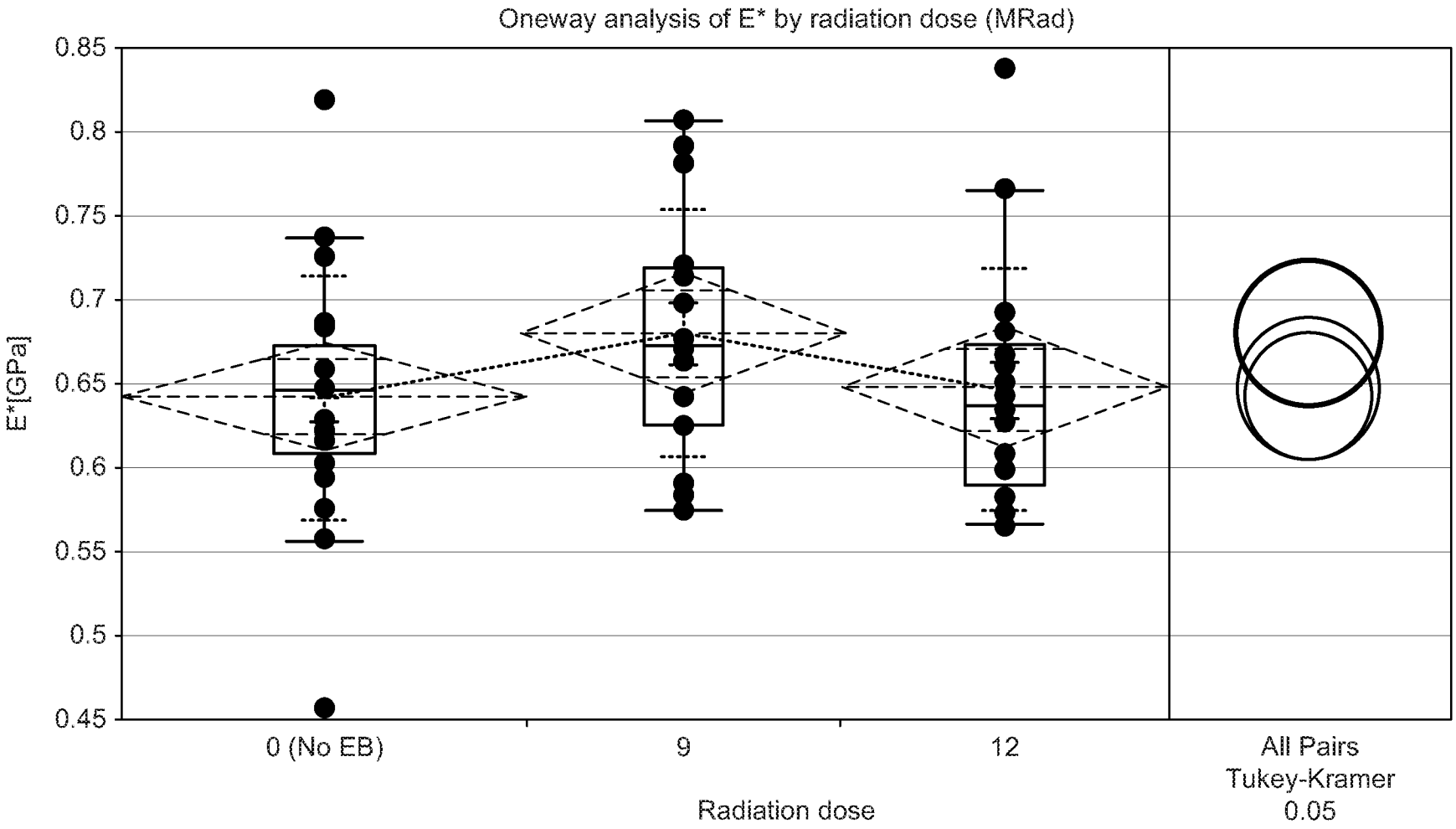
FIG. 2 is a graph showing the elastic modulus of non-irradiated and EB irradiated substrates.
Figure 3:
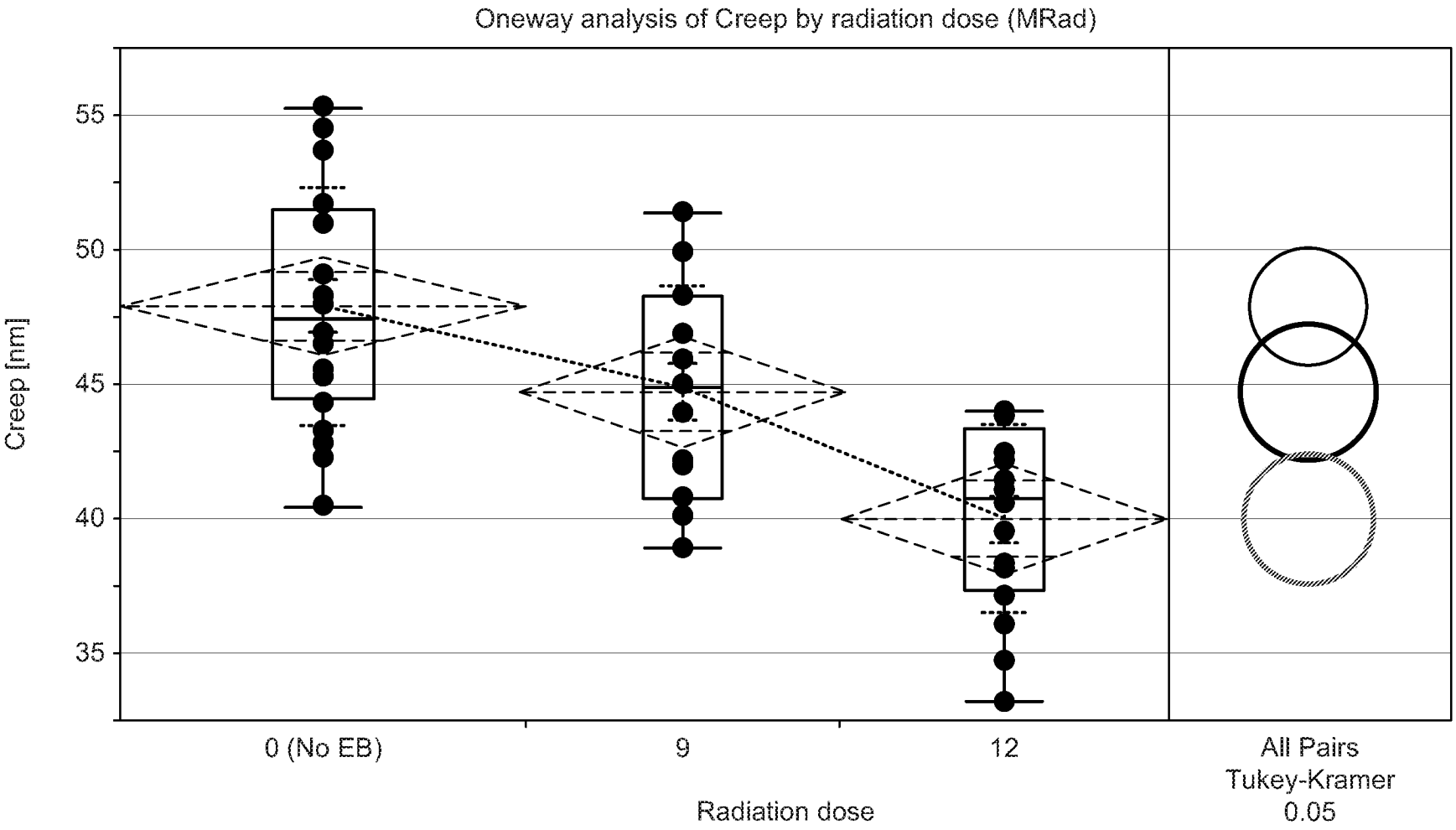
FIG. 3 is a graph showing creep of non-irradiated and EB irradiated substrates.

Each sample was measured at at least 15 different locations, to achieve high accuracy results. After data analysis, the parameters of Elastic Modulus (GPa) and total creep (nm) were plotted for the three samples. FIG. 2 shows the Elastic Modulus of the samples and FIG. 3 shows the Creep of the samples after nano-indenter loading at maximum load for 15 sec. The test reveals lower creep as the EB radiation intensity increases, while the elastic modulus remains broadly the same. This may indicate that EB radiation changes the plastic properties of the ink, possibly resulting in a denser ink, due to the EB radiation. A possible mechanism to explain such a change in plastic deformation with little or no change in elastic properties may be due to EB causing an increase in branching of the polymer chains which may, in turn, cause enhanced strain hardening.

Example 7—Creep Using DMA Test

Two samples of thin 186 μm sheets of Cyan pigmented liquid ElectroInk were tested for Dynamic Mechanical Analysis (DMA). One sample was used as a reference, while the other was irradiated by EB using an ebeam technologies Core 100/760 machine. The irradiation voltage was 100 kV, with dose of 12 MRad. The sheets were then cut to "dog-bone" shapes, with dimensions of 13.2 mm neck length and 2 mm neck width and tested for DMA, using a Bargal Analytical Instruments, DSC Q800. The test conditions used were: —temperature range 30-80° C.; temperature increment 5° C.; stress 0.5 MPa constant loading; delay time 7 minutes (for each increment).

Figure 4:
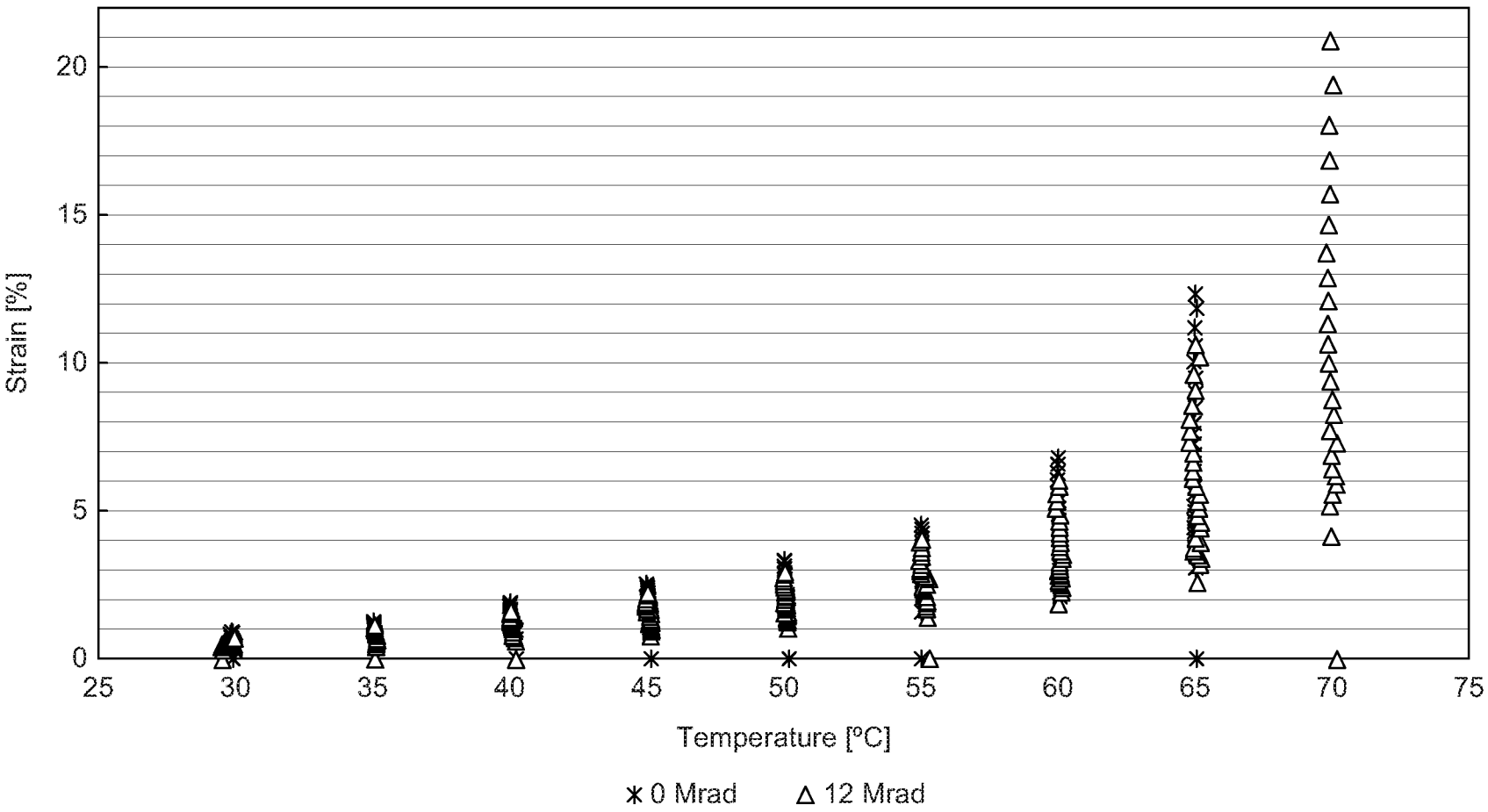
FIG. 4 is a graph showing creep resistance behaviour of non-irradiated and EB irradiated substrates.

FIG. 4 shows the influence of the temperature on the strain (%) of the samples (0 MRad—reference and 12 MRad) during the DMA test. The results indicate that irradiated samples exhibit a lower creep compared with non-irradiated samples (0 MRad). In addition, the non-irradiated sample was torn at 70° C., while 12 MRad sample was torn at temperature above 70° C. The smaller creep and higher failure temperature for the irradiated sample are additional evidence that EB treatment improves the plastic properties of the ink.

These results are correlated to what was witnessed during the stress sealing process in Example 1. In these examples, electron beam treatment resulted in reduced creep at higher temperatures. Since ink creep is reduced, the printed substrate may better withstand higher temperatures during a sealing process, with minimal ink movement.

The invention claimed is:

1. An electrophotographic printing method comprising:

electrophotographically printing a liquid electrophotographic composition onto a substrate, wherein the liquid electrophotographic composition comprises a charge adjuvant and a copolymer of a) ethylene and b) methacrylic acid and/or acrylic acid, wherein 80 to 95 weight % of the units of said copolymer are derived from ethylene;

coating the substrate having the liquid electrophotographic composition thereon with an overprint varnish; and subjecting the printed substrate with the overprint varnish thereon to electron beam radiation having an electron energy of 10 keV to 300 keV for a time period that branches ethylene-derived copolymer units in the liquid electrophotographic composition.

2. A method as claimed in claim 1, wherein the liquid electrophotographic composition further comprises a charge director, a colorant and a liquid carrier.

3. A method as claimed in claim 1, wherein 84 to 92 weight % of the units of said copolymer are derived from ethylene and from 8 to 16 weight % of the units of said copolymer are derived from methacrylic acid and/or acrylic acid.

4. A method as claimed in claim 1, wherein the liquid electrophotographic composition comprises a first copolymer that is a copolymer of ethylene and acrylic acid, and a second copolymer that is a copolymer of ethylene and methacrylic acid, wherein 80 to 95 weight % of the units of each of the first and second copolymers are derived from ethylene.

5. A method as claimed in claim 4, wherein the weight ratio of the first copolymer to the second copolymer is 70-90: 30-10.

6. A method as claimed in claim 4, wherein 85 to 92 weight % of the units of the first copolymer are derived from ethylene, and wherein 80 to 90 weight % of the units of the second copolymer are derived from ethylene.

7. A method as claimed in claim 1, wherein the concentration of ethylenically unsaturated groups in the copolymer is less than 0.05 meq/g.

8. A method as claimed in claim 1, further comprising applying a primer onto the substrate prior to the electrophotographic printing.

9. A method as claimed in claim 1, further comprising subjecting at least a portion of the printed substrate to a temperature of at least 150° C. after the printed substrate has been subjected to electron beam radiation;

wherein the portion of the printed substrate is subjected to a temperature of at least 150° C. and pressing the portion against another portion of substrate to form a seal.

10. A method as claimed in claim 1, wherein the electron beam radiation is applied at a dose from about 15 kGy (1.5 MRad) to about 250 kGy (25 MRad).

11. A method as claimed in claim 1, wherein the electron beam radiation is applied at a dose from about 20 kGy (2 MRad) to about 180 kGy (18 MRad).

12. A method as claimed in claim 1, wherein the electron beam radiation is applied at a dose from about 40 kGy (4 MRad) to about 120 kGy (12 MRad).

13. A method as claimed in claim 1, wherein the liquid electrophotographic composition consists essentially of the charge adjuvant, the copolymer of the ethylene and the methacrylic acid and/or the acrylic acid, the charge adjuvant, the charge director, and the liquid carrier.

14. A method as claimed in claim 4, wherein the weight ratio of the first copolymer to the second copolymer is 7:3.

15. A method as claimed in claim 1, wherein the overprint varnish is an electron beam curable varnish.

16. A method as claimed in claim 1, wherein the copolymer consists essentially of a) ethylene and b) methacrylic acid and/or acrylic acid.

17. A method as claimed in claim 1, wherein the copolymer has a melting point ranging from 85° C. to 110° C.

* * * * *